United States Patent [19]

Bingham et al.

[11] 4,394,535

[45] Jul. 19, 1983

[54] SPLIT PHASE STEREOPHONIC SOUND SYNTHESIZER

[75] Inventors: Joseph P. Bingham, Carmel; John F. Benford, Indianapolis, both of Ind.

[73] Assignee: RCA Corporation, New York, N.Y.

[21] Appl. No.: 241,926

[22] Filed: Mar. 9, 1981

[51] Int. Cl.[3] ..... H04R 5/00; H04S 5/00

[52] U.S. Cl. ..... 179/1 GP; 358/198

[58] Field of Search ..... 179/1 GP, 1 G; 358/198

[56] References Cited

U.S. PATENT DOCUMENTS

| | | | |
|---|---|---|---|
| 3,056,854 | 10/1962 | Katzenstein et al. | 178/5.8 |
| 3,219,757 | 11/1965 | Palladino | 179/1 |
| 3,670,106 | 6/1972 | Orban | 179/1 GP |
| 4,239,939 | 12/1980 | Griffis | 179/1 GP |

FOREIGN PATENT DOCUMENTS

| | | |
|---|---|---|
| 15770 | 9/1980 | European Pat. Off. . |
| 1168972 | 4/1964 | Fed. Rep. of Germany . |

OTHER PUBLICATIONS

"New Dimension in TV Sound" *Radio-Electronics*, Feb./1981, Savon, p. 50.

"TV Sound Adaptor" published in Practical Electronics, vol. 12, No. 3, p. 234, Mar. 1976.

*Primary Examiner*—R. J. Hickey

*Attorney, Agent, or Firm*—E. M. Whitacre; P. J. Rasmussen; L. C. Edelman

[57] ABSTRACT

A stereophonic sound synthesizer system is presented which utilizes a phase splitter in the form of a transformer to develop two oppositely phased audio signals from an applied monaural signal. One of the two oppositely phased signals is applied to a transfer function circuit of the form H(s), which modulates the intensity of a monaural signal as a function of the frequency. The intensity modulated H(s) signal may be applied to an amplifier for subsequent amplification and reproduction. The H(s) signal is also combined with the other of the two oppositely phased signals to produce a difference signal which is the complement of the H(s) signal. The difference signal may be applied to an amplifier for subsequent amplification and reproduction. No differential amplifier is necessary to produce the difference signal because the necessary selective phase opposition of the signals combined in that channel is provided by the use of the oppositely phased transformer output signals. In addition, the transformer electrically isolates the television's electrical system from the stereo synthesizer system's signal outputs.

10 Claims, 7 Drawing Figures

SPLIT PHASE STEREOPHONIC SOUND SYNTHESIZER

This invention relates to a system which synthesizes stereophonic sound by developing two separate sound channels from a single monophonic sound source in general and, in particular, to the employment of such a synthetic stereophonic sound system in combination with a visual display such as a television receiver.

True stereophony is characterized by two distinct qualities which distinguish it from single-channel reproduction. The first of these is directional separation of sound sources and the second is the sensation of "depth" and "presence" that it creates. The sensation of separation has been described as that which gives the listener the ability to judge the selective location of various sound sources, such as the position of the instruments in an orchestra. The sensation of presence, on the other hand, is the feeling that the sounds seem to emerge, not from the reproducing loudspeakers themselves, but from positions between and usually somewhat behind the loudspeakers. The latter sensation gives the listener an impression of the size, acoustical character, and depth of the recording location. In order to distinguish between presence and directional separation, which contributes to presence, the term "ambience" has been used to describe presence when directional separation is excluded. The work of various experimenters has led to the conclusion that the sensation of ambience contributes far more to the stereophonic effect than separation.

Various efforts have been directed toward creating the sensation of true stereo synthetically. Such a synthetic or quasi-stereophonic system attempts to create an illusion of spatially distributed sound waves from a single monophonic signal. This effect has been obtained by delaying a monophonic signal A by 50–150 milliseconds to develop a signal B. A listener using separate earphones receives an A+B signal in one earphone and A−B signal in the other. The listener receives a fairly definite spatial impression of the second field.

The synthetic stereophonic effect arises due to an intensity-vs-frequency as well as an intensity-vs-time difference in the indirect signal pattern set up at the two ears of the listener. This gives the impression that different frequency components arrive from different directions due to room reflection echoes, giving the reproduced sound a more natural, diffused quality.

True stereophonic sound reproduction preserves both qualities of directional separation and ambience. Synthesized stereophonic sound reproduction, however, does not attempt to recreate stereo directionality, but only the sensation of depth and presence that is a characteristic of true two-channel stereophony. However, some directionality is necessarily introduced, since sounds of certain frequencies will be reproduced fully in one channel and sharply attenuated in the other as a result of either phase or amplitude modulation of the signals of the two channels.

When a true stereophonic sound reproduction system is utilized in combination with a visual medium, such as television or motion pictures, the two qualities of directional separation and ambience create an impression in the mind of the viewer-listener that he is a part of the scene. The sensation of ambience will recreate the acoustical properties of the recording studio or location, and the directional sensation will make various sounds appear to emanate from their respective locations in the visual image. In addition, since the presence effect produces the sensation that sounds are coming from positions behind the plane of the loudspeakers, a certain three-dimensional effect is also produced.

The use of a synthesized stereopnonic sound reproduction system in combination with a visual medium will produce a somewhat similar effect to that which is realized with true stereo. A stereophonic sound synthesizer which produces the effects of ambience, depth and presence is described in U.S. Pat. No. 4,239,939. The system there described develops two complementary spectral intensity modulated signals from a single monaural signal. The monaural signal is applied as the input signal for a transfer function circuit of the form H(s), which modulates the intensity of the monaural signal as a function of frequency. The intensity modulated H(s) signal is coupled to a reproducing loudspeaker, and comprises one channel of the synthetic stereo system. The H(s) signal is also coupled to one input of a differential amplifier. The monaural signal is coupled to the other input of the differential amplifier to produce a difference signal which is the complement of the H(s) signal. The difference signal is coupled to a second reproducing loudspeaker, which comprises the second channel of the synthetic stereo system.

In the embodiment shown in that patent, the H(s) transfer function circuit is comprised of two twin-tee notch filters, which produce notches of reduced signal level at 150 Hz and 4600 Hz. The channel comprised solely of the intensity modulated H(s) signal therefore exhibits a response characteristic with points of maximum attenuation at these two frequencies. Intermediate these two attenuation frequencies is a frequency at which the response characteristic exhibits a peak amplitude for applied audio signals.

The difference signal channel of the system produces the difference signal by subtractively combining the two in-phase signals at its inputs. One of these input signals is the monaural signal and the other is the monaural signal which has been processed by the H(s) circuit. At the two attenuation frequencies of the H(s) channel, only a very low level signal is substracted from the monaural signal, and the difference signal exhibits peak amplitudes at these frequencies. At the intermediate frequency at which the H(s) signal level is high, the subtraction of one signal from the other cancels much of the monaural signal, thereby producing a point of maximum attenuation in the response characteristic of the difference channel.

In another embodiment of this invention, such as that shown as the MSS001A Synthesis Stereo Module on page 39 of the RCA Television Service Data Booklet, File 1980 C-7, for the CTC 101 Series Chassis, the differential amplifier used to produce the difference signal is a power amplifier which is capable of directly driving a television loudspeaker. The H(s) signal is applied to a similar power amplifier for driving a second loudspeaker. The power amplifier outputs are connected to loudspeakers located on either side of the kinescope to provide synthetic stereo television sound reproduction.

In the television receivers described in the abovementioned RCA Television Service Data Booklet, the loudspeakers are located in the cabinet of the receiver. The apparent width of the synthetic stereo sound field is determined by the separation, or distance, between the two loudspeakers. Since the width of the cabinet of a television receiver using a twenty-five inch diagonal picture tube is relatively narrow (approximately four feet or less), the apparent width of the sound field is constrained to this dimension. Accordingly, it is desirable to provide a larger spacing between the two loudspeakers in order to develop an increased sensation of depth and presence of the synthetic stereo sound field.

It has been found by the present inventors that the width dimension of the synthetic stereo sound field can be expanded by providing two output channels of synthetic stereo sound on the television receiver which are adapted to be applied to auxiliary loudspeakers placed on either side of the receiver by the viewer-listener. Since the auxiliary loudspeakers used may conveniently be components of the viewer-listener's stereo hi-fidelity system, the two output channels are designed to provide low level audio signals which may be directly applied to the preamplifier of a hi-fidelity system, amplified, and then applied to the hi-fidelity loudspeakers. In this arrangement, it is no longer necessary to use power amplifiers in the television receiver for the output channels, since the television receiver is not driving the loudspeakers directly. This elimination of the power amplifiers results in a cost saving in the manufacture of the synthetic stereo system.

However, elimination of the power amplifiers eliminates the differential amplifier necessary to produce the difference signal in the above-described embodiments of the invention of U.S. Pat. No. 4,239,939. Accordingly, it becomes necessary to devise a different technique for developing the difference signal. In addition, safety requirements mandate that electrical connections such as the output channels for the hi-fidelity system be electrically isolated from the electrical system of the television receiver in order to prevent the creation of any shock hazard to the viewer-listener.

In accordance with the principles of the present invention, a stereophonic sound synthesizer system is presented which utilizes a transformer to develop two oppositely phased audio signals from an applied monaural signal. One of the two oppositely phased signals is applied to a transfer function circuit of the form H(s), which modulates the intensity of the monaural signal as a function of the frequency. The intensity modulated H(s) signal may be applied to an amplifier for subsequent amplification and reproduction. The H(s) signal is also combined with the other of the two oppositely phased signals to produce a difference signal which is the complement of the H(s) signal. The difference signal may be applied to an amplifier for subsequent amplification and reproduction. No differential amplifier is necessary to produce the difference signal because the necessary selective phase opposition of the signals combined in that channel is provided by the use of the oppositely phased transformer output signals. In addition, the transformer electrically isolates the television's electrical system from the stereo synthesizer system's signal outputs.

In the drawings:

FIG. 1*a* illustrates, partially in block diagram form and partially in schematic diagram form, a synthetic stereophonic sound system constructed in accordance with the principles of the present invention;

FIGS. 1*b*–1*d* illustrate response characteristics at the input and outputs of the system of FIG. 1*a*;

Figure 1D:
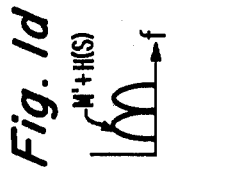
Figure 1C:
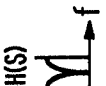
Figure 1B:
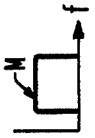
Figure 1A:
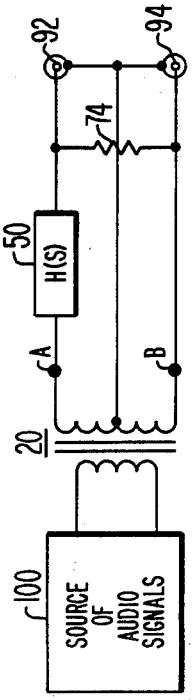

Referring to FIG. 1*a*, a source of monophonic audio signals 100 is shown coupled to apply audio signals to the primary winding of a transformer 20. The audio signals may occupy the conventional audio frequency spectrum of 20 to 20,000 Hertz, and exhibit an essentially uniform response characteristic over this range of frequencies, as shown by response characteristics M of FIG. 1*b*.

The monophonic audio signals applied to the primary of the transformer 20 result in the development of monophonic audio signals of opposite phase relationship at signal points A and B, which are coupled to respective ends of a center-tapped secondary of the transformer 20. The signal at point A is applied to an H(s) transfer function circuit 50, which modulates the applied signal in intensity and phase as a function of frequency, and applies the resultant H(s) signal to an output terminal 92. The response characteristic at the output terminal 92 is illustratively shown by the H(s) characteristic of FIG. 1*c*.

The oppositely phased monophonic signal at point B is applied to an output terminal 94, together with a component of the H(s) signal which is applied by way of resistor 74. Since the signal produced by the H(s) signal is opposite in phase to the signal at point B, signal cancellation will occur over its frequency spectrum at frequencies at which the signal amplitudes are substantially the same. As a result of this cancellation, the response characteristic at output terminal 94 is complementary to that of FIG. 1*c*, as illustrated by the M′+H(s) response characteristic to FIG. 1*d*.

The signals produced at output terminals 92 and 94 will produce a synthetic stereophonic sound field when amplified and applied to separate loudspeakers. Sounds of different frequencies will appear to emanate from different loudspeakers, or from points between the two loudspeakers, as a function of their respective locations in the response characteristic of the two outputs. The full sound spectrum is contained in the combined output signals, but is modulated in intensity as a function of frequency in a complementary manner at the two outputs.

Figure 2:
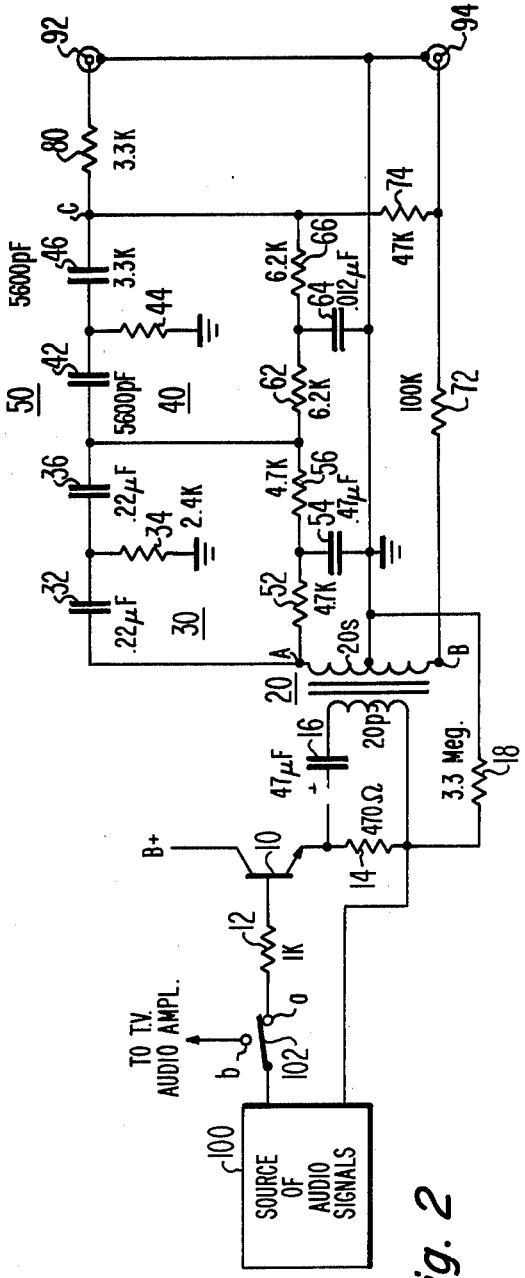
FIG. 2 illustrates, partially in block diagram form and partially in schematic diagram form, a detailed embodiment of a synthetic stereophonic sound system constructed in accordance with the principles of the present invention.

An embodiment of the present invention is shown in schematic detail in FIG. 2. A source of monophonic audio signals 100 is coupled to the base of a transistor 10 by way of a switch 102 and a resistor 12. Transistor 10 is coupled in a common collector configuration with its collector coupled to a source of supply voltage (B+) and its emitter coupled to a return path to signal source 100 by a resistor 14. The emitter of transistor 10 is coupled to one end of the primary winding 20*p* of transformer 20 by a capacitor 16. The other end of winding 20*p* is coupled to the audio signal return path at the end of resistor 14 remote from the emitter of transistor 10. This end of primary winding 20*p* is also coupled to an intermediate tap of secondary winding 20*s* of transformer 20 by a resistor 18. The intermediate tap of the secondary winding 20*s* is also coupled to a point of reference potential (ground).

The respective ends of the transformer secondary winding 20*s* are coupled to points A and B, at which opposite-phase audio signals are produced. Point A is coupled to an H(s) transfer function circuit comprising twin-tee notch filters 30 and 40. The first notch filter 30 includes capacitors 32 and 36, which are serially coupled between point A and notch filter 40. A resistor 34 is coupled between the junction of capacitors 32 and 36 and ground. The first notch filter 30 also includes resistors 52 and 56, which are coupled in series between point A and the plate of capacitor 36 remote from resistor 34. A capacitor 54 is coupled between the junction of resistors 52 and 56 and ground.

The second notch filter includes capacitors 42 and 46, serially coupled between the junction of resistor 56 and capacitor 36 and a point C. A resistor 44 is coupled between the junction of capacitors 42 and 46 and ground. Resistors 62 and 66 are coupled in series between the junction of capacitor 36 and resistor 56 and point C. A capacitor 64 is coupled between resistors 62 and 66 and ground.

An audio signal, modulated in accordance with the H(s) transfer function circuit 50, is produced at point C. This H(s) signal is applied to output terminal 92 by a resistor 80, which provides an output impedance that matches the required input impedance of a home stereo amplifier.

Point B at the secondary winding 20*s* of the transformer 20 is coupled by a resistor 72 to output terminal 94. A resistor 74 is coupled between the H(s) signal point C and the junction of resistor 72 and output terminal 94. The H(s) signal is combined with the oppositely phased transformer output signal at the junction of resistors 72 and 74. The output terminals 92 and 94 in FIG. 2 are illustratively shown as conventional coaxial terminals and include return connections to signal reference potential at the transformer tap.

In operation, switch 102 is in either the "a" or the "b" position. In the "b" position, the low level audio signal from signal source 100 is applied to the audio amplifier in the television receiver (not shown) and thence to the television loudspeaker (shown as loudspeaker 114 in FIG. 4) for normal monaural reproduction. In the "a" position, the audio signal is applied by the emitter-follower-coupled transistor 10 to the primary winding 20*p* of transformer 20. Antiphase audio signals are developed at points A and B, which signals are modulated by the H(s) circuit 50 and combined at the junction of resistors 72 and 74 to develop the two synthetic stereo output signals at terminals 92 and 94.

Figure 3:
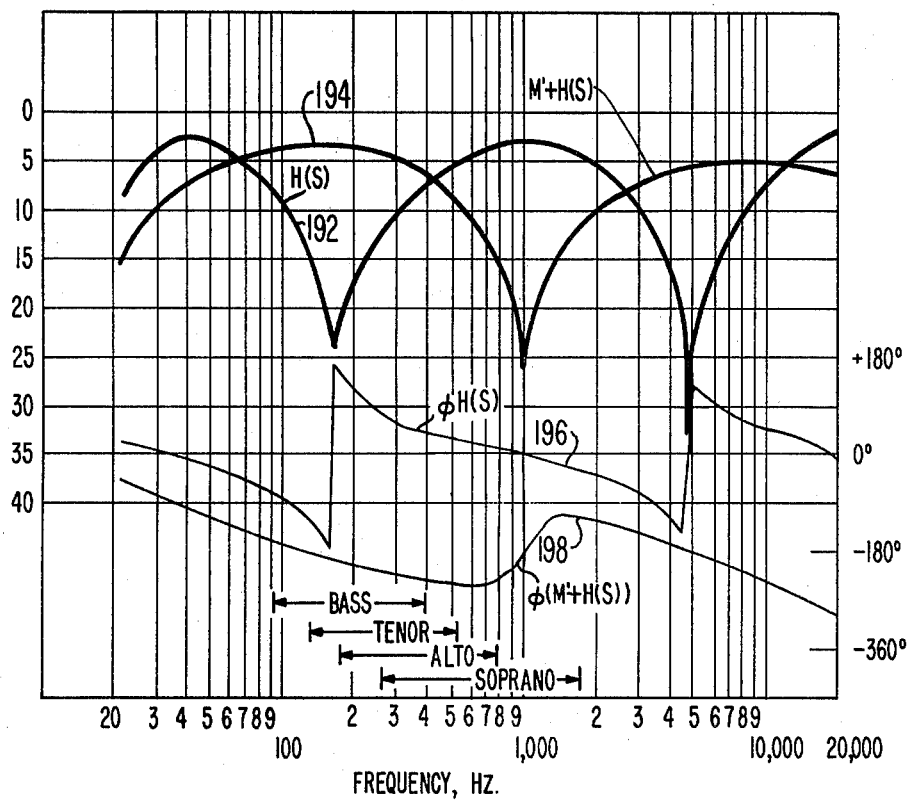
FIG. 3 illustrates amplitude and phase response characteristics of the embodiment of FIG. 2.

The characteristic responses at output terminals 92 and 94 are shown in FIG. 3. The amplitude response of the H(s) signal channel at terminal 92 is shown by curve 192. This curve exhibits a notch of maximum attenuation at 150 Hz, resulting from the first notch filter 30. The second notch filter 40 produces the second notch of maximum attenuation at 4600 Hz. The H(s) signal channel also exhibits a phase response as shown by waveform 196. This waveform illustrates that the H(s) signal undergoes a sharp phase reversal of approximately 180 degrees at each notch frequency.

The amplitude response in the complementary signal channel at terminal 94 is shown by curve 194. This response curve 194 is seen to exhibit a notch of maximum attenuation at approximately 1000 Hz, at which frequency the amplitiude of the H(s) channel response curve 192 is at a maximum. The phase response of the complementary signal channel is represented by curve 198. This curve exhibits a phase shift of slightly more than 90 degrees at the 1000 Hz notch frequency. The depth of the complementary channel notch, and the frequency at which it is located, is determined by the amplitude modulation provided by the H(s) transfer function circuit to the signal at point A, and the antiphase relationship of the signals at points A and B.

It is desirable for the H(s) signal response to be in an antiphase relationship with the signal at point B at the frequency at which the H(s) response curve 192 is at a maximum in order to produce a complementary notch of maximum notch depth in the complementary signal channel. The phase response curve 196 of the H(s) channel is at a phase of 0° relative to the signal phase at point A when the amplitude of the H(s) response curve 192 is at its maximum at approximately 1000 Hz. At this frequency, the audio signal at point B exhibits a significant amplitude and is in an antiphase relationship with respect to the signal at point C. The H(s) signal at point C and the signal at point B are combined by resistors 74 and 72. The antiphase relationship of the two substantially equal amplitude signals at 1000 Hz results in signal cancellation at this frequency, thereby producing the characteristic notch in complementary response curve 194.

The phase response curves 196 and 198 also demonstrate that the two signal channels are in an antiphase relationship at the notch frequencies of the H(s) channel. This antiphase relationship occurs midway during the 180 degree phase reversals at the notch frequencies. However, the amplitude of the H(s) signal is sharply attenuated by the notch filter at these frequencies. Thus, there is substantially no signal amplitude of the H(s) signal at these frequencies to cancel the antiphase signal at this time. The complementary signal channel therefore exhibits points of maximum amplitude at the H(s) notch frequencies.

The phase response curves 196 and 198 reveal that signals produced by the two channels will be in a substantially constant phase relationship of approximately ninety degrees between the three notch frequencies. When the signals are reproduced by loudspeakers, the signals in the resulting sound field will neither additively combine (as they would if they were in phase) nor will they cancel each other (as they would if they were in an antiphase relationship) at the ears of the listener. Instead, the responses of the loudspeakers will be substantially as shown by the amplitude response curves 192 and 194, without a phase "tilt" which would tend to reinforce or cancel sound signals at certain frequencies. The perceived ambience effect of the synthesized stereo sound field is therefore developed by the varying ratios of the sound signal amplitudes produced by the loudspeakers over the sound frequency spectrum, and the effects of signal phase relationship on the sound field may be neglected.

Moreover, it has been found that a phase differential of 90° between the two output signals will produce a distributed sound field which appears to just cover the space between the two loudspeakers. At phase differentials less than 90°, the distribution is narrower, and at phase angles in excess of 90°, the sound field increases in dimension until it appears to cover the entire 180° plane of the two loudspeakers. By maintaining the ninety-degree phase differential between the notch frequencies, this phenomenon may be advantageously utilized by the listener to create a sound field size of his own liking.

Figure 4:
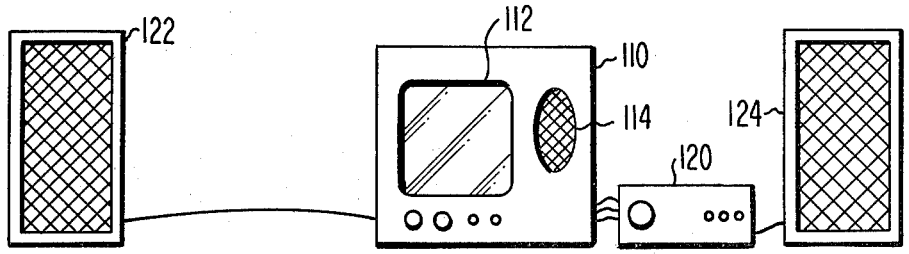
FIG. 4 illustrates the use of an embodiment of the present invention in combination with a home stereo system.

A typical arrangement in which the synthetic stereo sound system is used in combination with a television receiver is shown in FIG. 4. A television receiver 110, including a kinescope 112 and a monophonic loudspeaker 114, is centered between two loudspeakers 122 and 124. The receiver 110 includes the synthetic stereo sound system of FIG. 2, with output terminals 92 and 94 being coupled to a home stereo amplifier 120. The low level synthetic stereo signals produced at the two output terminals are amplified by the amplifier 120, which drives the two loudspeakers. The listener can position the loudspeakers at whatever distance he desires relative to the television kinescope to produce a synthetic stereo sound field of a desired dimension about the television receiver.

Since the two loudspeakers 122 and 124 produce sound signals which correspond to the amplitude response curves 192 and 194 of FIG. 3, it may be appreciated that different frequency sounds will appear to come from different loudspeakers, or some point between the two. For instance, if the H(s) signal loudspeaker 122 is placed to the left of the listener and the complementary signal loudspeaker 124 to the right, a 150 Hz tone will be reproduced primarily in the right loudspeaker, and a 1000 Hz tone would come from the left loudspeaker. Tones between these two notch frequencies would appear to come from locations intermediate the left and right loudspeaker; for example, a 400 Hz tone would appear to come from a point halfway between the two loudspeakers, since such a tone will be reproduced with equal intensity in the two loudspeakers. When the synthetic stereo system reproduces television sound signals having a large number of different frequency components, such as music from a symphony orchestra or the voices of a large crowd, different frequency components will appear to come simultaneously from different directions, giving the listener a more realistic sensation of the ambience of the concert.

However, when the synthetic stereo system is used with a television receiver or other visual medium, a further complication must be considered. This is the possibility that the synthetic stereo system can create a disturbing separation sensation in the perception of the viewer-listener if the frequency spectrum is improperly divided between the two sound channels. For instance, assume that a television viewer is watching and listening to a scene including a speaker with a bass voice on the left side of the television image and a speaker with a soprano voice on the right side. Virtually all of the sound power of the bass voice will be concentrated below 350 Hz and a large portion of the sound power of the soprano voice will appear above this frequency, as shown by the voice ranges illustrated at the bottom of FIG. 3. If the frequency spectrum is divided such that frequencies above 350 Hz are emphasized by the right loudspeaker 124 and frequencies below 350 Hz are emphasized by the left loudspeaker 122, the voice reproduction will be reversed with respect to the video images. This confusing reversal of the sound and picture images is substantially prevented in the present invention by careful selection of the notch and crossover frequencies of the response curves 192 and 194.

Voice ranges for bass, tenor, alto and soprano speakers are shown in FIG. 3. Analysis of the intensity versus frequency response characteristics of these four voice ranges has shown that the human voice has an average intensity which peaks in the range of 350 to 400 Hz. This fact is advantageously taken into consideration in the present invention by locating the 150 and 1000 Hz notch frequencies of response curves 192 and 194 so that the response curves exhibit a crossover frequency in the vicinity of the range of peak intensity. At the crossover frequency of approximately 400 Hz in FIG. 3, sounds are reproduced by loudspeakers 122 and 124 with substantially equal intensity. Therefore, the synthetic stereo sound system will cause voices to appear to emanate from the center of the kinescope, on the average, when the television receiver 110 is centered with respect to the two loudspeakers. Annoying reversal of voices with respect to the video images is thereby prevented by centering the voice sounds in the sound field.

What is claimed is:

1. A stereo synthesizer for producing synthesized stereo sound signals from monophonic input signals comprising:

a source of monophonic sound signals;

a phase splitter circuit having an input coupled to said source of monophonic sound signals and first and second outputs at which monophonic sound signals of opposite phase relationship are produced;

a transfer function circuit having an input coupled to said first output of said phase splitter circuit and an output, and exhibiting an amplitude versus frequency response characteristic including two spaced frequencies of maximum attenuation and a frequency of minimum attenuation intermediate said spaced frequencies within an audio frequency range occupied by said monophonic sound signals, for producing an intensity modulated signal at said transfer function circuit output;

a first output terminal responsive to said output of said transfer function circuit for producing a first synthesized stereo sound signal;

a second output terminal;

means for transferring monophonic sound signals from said second output of said phase splitter circuit to said second output terminal without introduction of variations in amplitude or phase with frequency over said audio frequency range; and means for transferring intensity modulated signals from said output of said transfer function circuit to said second output terminal without further introduction of variations in amplitude or phase with frequency over said audio frequency range to develop a second synthesized stereo sound signal.

2. The stereo synthesizer of claim 1, wherein said phase splitter circuit comprises a transformer having a primary winding coupled to said source of monophonic sound signals, and a tapped secondary winding with first and second ends comprising said first and second outputs and the tap point of said secondary winding coupled to a point of signal reference potential.

3. The stereo synthesizer of claim 2, wherein said means for transferring monophonic sound signals from said second output of said transformer to said second output terminal comprises a first passive network having an input coupled to an end of said transformer secondary winding and an output coupled to said second output terminal; and said means for transferring intensity modulated signals from said output of said transfer function circuit to said second output terminal comprises a second passive network having an input coupled to the output of said transfer function circuit and an output coupled to said first passive network, wherein said second synthesized stereo sound signal is developed at the junction of said first and second passive networks.

4. The stereo synthesizer of claim 3, further comprising a third passive network having an input coupled to the output of said transfer function circuit and an output coupled to said first output terminal.

5. The stereo synthesizer of claims 1 or 4, wherein said transfer function circuit comprises first and second cascaded twin-tee notch filters.

6. In a system which reproduces correlated sound and visual information, including a source of correlated monophonic sound and visual signals; means, coupled to said signal source and including a video reproduction medium, for displaying visual information derived from said visual signals; a synthetic stereo sound system comprising:

a phase splitter circuit having an input coupled to said signal source for receiving said monophonic sound signals and first and second outputs at which monophonic sound signals of opposite phase relationship are produced;

a transfer function circuit having an input coupled to said first output of said phase splitter circuit and an output, and exhibiting an amplitude versus frequency response characteristic including two spaced frequencies of maximum attenuation and a frequency of minimum attenuation intermediate said spaced frequencies within an audio frequency range occupied by said monophonic sound signals, for producing an intensity modulated signal at said transfer function circuit output;

a first output terminal responsive to said output of said transfer function circuit for producing a first synthesized stereo sound signal;

a second output terminal;

means for transferring monophonic sound signals from said second output of said phase splitter circuit to said second output terminal without introduction of variations in amplitude or phase with frequency over said audio frequency range;

means for transferring intensity modulated signals from said output of said transfer function circuit to said second output terminal without further introduction of variations in amplitude or phase with frequency over said audio frequency range to develop a second synthesized stereo sound signal;

first and second loudspeakers located at respective opposite sides of said visual information display means; and means for coupling said first and second output terminals to said first and second loudspeakers, respectively, for producing a synthetic stereo sound field about said visual information display means.

7. A television sound and image reproduction system, including a source of television sound and video signals; a television receiver enclosure, a kinescope mounted in said enclosure for reproducing video information; and means responsive to said video signals for applying video information to said kinescope for reproduction; said reproduction system also including a synthetic stereo sound system comprising:

a phase splitter circuit having an input coupled to said signal source for receiving said television sound signals and first and second outputs at which television sound signals of opposite phase relationship are produced;

a transfer function circuit having an input coupled to said first output of said phase splitter circuit and an output, and exhibiting an amplitude versus frequency response characteristic including two spaced frequencies of maximum attenuation and a frequency of minimum attenuation intermediate said spaced frequencies within an audio frequency range occupied by said television sound signals, for producing an intensity modulated signal at said transfer function circuit output;

a first output terminal responsive to said output of said transfer function circuit for producing a first synthesized stereo sound signal;

a second output terminal;

means for transferring television sound signals from said second output of said phase splitter circuit to said second output terminal without introduction of variations in amplitude or phase with frequency over said audio frequency range;

means for transferring intensity modulated signals from said output of said transfer function circuit to said second output terminal without further introduction of variations in amplitude or phase with frequency over said audio frequency range to develop a second synthesized stereo sound signal;

an amplifier located external to said enclosure, and including first and second amplifying channels having respective inputs coupled to said first and second output terminals, and respective first and second outputs;

first and second loudspeakers located external to said enclosure and subject to being placed by a user at positions on opposite sides of said enclosure, and respectively coupled to said first and second outputs of said amplifier channels for reproducing said first and second synthesized stereo sound signals to develop a synthetic stereo sound field.

8. The system of claim 7, wherein said kinescope is centered with respect to the location of said first and second loudspeakers.

9. The system of claims 7 or 8, further comprising a third loudspeaker mounted in said enclosure; and a switch for selectively applying said television sound signals to either said phase splitter circuit or said third loudspeaker, wherein said television sound signals are applied to said third loudspeaker for reproduction of a monophonic television sound field.

10. The stereo synthesizer of claim 1 wherein said transfer function circuit exhibits a phase versus frequency response characteristic including phase variations with frequency within said audio frequency range; and said means for transferring monophonic sound signals to said second output terminal and said means for transferring intensity modulated signals to said second output terminal includes means for substantially equalizing the amplitude of said signals transferred to said second output terminal at frequencies wherein the phase difference between said transferred signals is 180°.

* * * * *